US005374054A

United States Patent [19]

Suess

[11] Patent Number: 5,374,054

[45] Date of Patent: Dec. 20, 1994

[54] BASKETBALL APPARATUS FOR RECLINED OR SEATED SPORTSMEN

[76] Inventor: Matthew G. Suess, 5920 Pleasant View Rd., Rock City, Ill. 61070

[21] Appl. No.: 266,364

[22] Filed: Jun. 27, 1994

[51] Int. Cl.[5] ..... A63B 69/00

[52] U.S. Cl. ..... 273/1.5 A

[58] Field of Search ..... 273/1.5 A, 397

[56] References Cited

U.S. PATENT DOCUMENTS

| | | | |
|---|---|---|---|
| 2,570,860 | 6/1949 | Redding . | |
| 4,291,885 | 9/1981 | Cohen | 273/1.5 AX |
| 4,714,248 | 12/1987 | Koss | 273/1.5 A |
| 4,715,600 | 12/1987 | Offutt | 273/1.5 R |
| 4,786,371 | 11/1988 | Postol | 273/1.5 A |
| 4,838,549 | 6/1989 | Woodall | 273/1.5 A |
| 4,955,605 | 9/1990 | Goldfarb | 273/1.5 A |
| 5,312,099 | 5/1994 | Oliver, Sr. | 273/1.5 A |

OTHER PUBLICATIONS

Recreation Sports & Leisure, Oct. 1985, Ball-Return Companion.

*Primary Examiner*—Paul E. Shapiro

[57] ABSTRACT

A basketball apparatus used in a seated or reclined position includes a backboard and hoop assembly, a catch net, a return trough, and a trough support cushion. The catch net is suspended from L-beams attached to the backboard, and feeds thrown balls along a downwardly inclined bottom surface to the return trough, and ultimately to the user. The trough is attached to the net such that the net is held tautly in shape on the L-beams. To return thrown balls, whether or not they had been thrown through the hoop, the net surrounds the hoop on three sides and is sized to allow leeway for missed balls. On the underside of the return trough a support cushion is attached which allows the opening of the trough to be comfortably positioned on a user's lap. The basketball apparatus is specifically adapted for in-home use by bedridden individuals.

7 Claims, 2 Drawing Sheets

BASKETBALL APPARATUS FOR RECLINED OR SEATED SPORTSMEN

BACKGROUND OF THE INVENTION

The present invention relates generally to a personal sports apparatus. More particularly, the present invention is a basketball apparatus which is adapted for use by reclined individuals.

Basketball is normally a sport which requires the use of the entire body to position, shoot, and rebound a ball through an elevated hoop. The sport has acquired substantial popularity as both a professional and amateur past time, enjoyed by many individuals as routine recreation. When such an individual is incapacitated due to illness, injury, exhaustion, or disability, the desire to actively participate in the sport may not abate. There is accordingly a long-felt need to accommodate this desire for those who are confined to a less mobile status with an apparatus which will allow them to at least aim and throw basketballs without having to unduly exert themselves in ball retrieval.

Basketball devices intended for home indoor use are known. For example, U.S. Pat. No. 4,715,600, issued to Offrutt, discloses a door mounted basketball backboard and rim assembly. U.S. Pat. No. 2,570,860, issued to Redding discloses a backboard and hoop toy which includes a ball fastened to the backboard with string.

Various arrangements for returning a basketball from the target area are also known. Goldfarb, U.S. Pat. No. 4,955,605 discloses a home basketball apparatus which includes a narrowing elongated return net which is suspended between a door and a chair. The requirement of a chair or the like to provide rigid support for the net at the distal or receiving end makes this apparatus unsuitable for the bedridden. A more structured basketball return device is disclosed by Koss, U.S. Pat. No. 4,714,248. Both of these devices are intended for standing use. None of the above inventions and patents, taken either singly or in combination, is seen to describe the instant invention as claimed.

SUMMARY OF THE INVENTION

The present basketball apparatus includes a backboard and hoop assembly, a catch net, a rigid return trough, and a trough support cushion. The catch net is suspended from a pair of L-shaped horizontal structures attached to the backboard. Thrown balls are captured in the catch net and gravitationally urged along its inclined bottom surface to the return trough, and ultimately to the user. To return substantially all balls, whether or not they had been thrown through the hoop, the net substantially surrounds the hoop on three sides and is sized to allow sufficient leeway for missed balls.

On the underside of the return trough, a support cushion is provided which allows the opening of the channel to be comfortably positioned on a user's lap. The substantially rigid trough is attached to the net such that the net is held tautly in shape on the structures from which they suspend. Further, the net is provided sufficient flexibility to absorb the energy of thrown balls, thereby reducing the incidence of balls bouncing on impact therewith.

Accordingly, it is a principal object of the invention to provide a basketball apparatus which is advantageously adapted to use by bedridden individuals.

It is another object of the invention to provide a device which preserves many of the natural aspects of basketball shooting without unduly stressing the user with ball retrieval.

It is yet another object of the invention to provide an apparatus, by virtue of being used while in a seated or reclined position, that allows balls to be thrown in a greater vertical trajectory while under the same restrictions of normal indoor ceiling heights.

It is a further object of the invention to provide an apparatus which achieves its objectives efficiently, with uncomplicated and accordingly inexpensive construction and assembly.

These and other objects of the present invention will become readily apparent upon further review of the following description and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
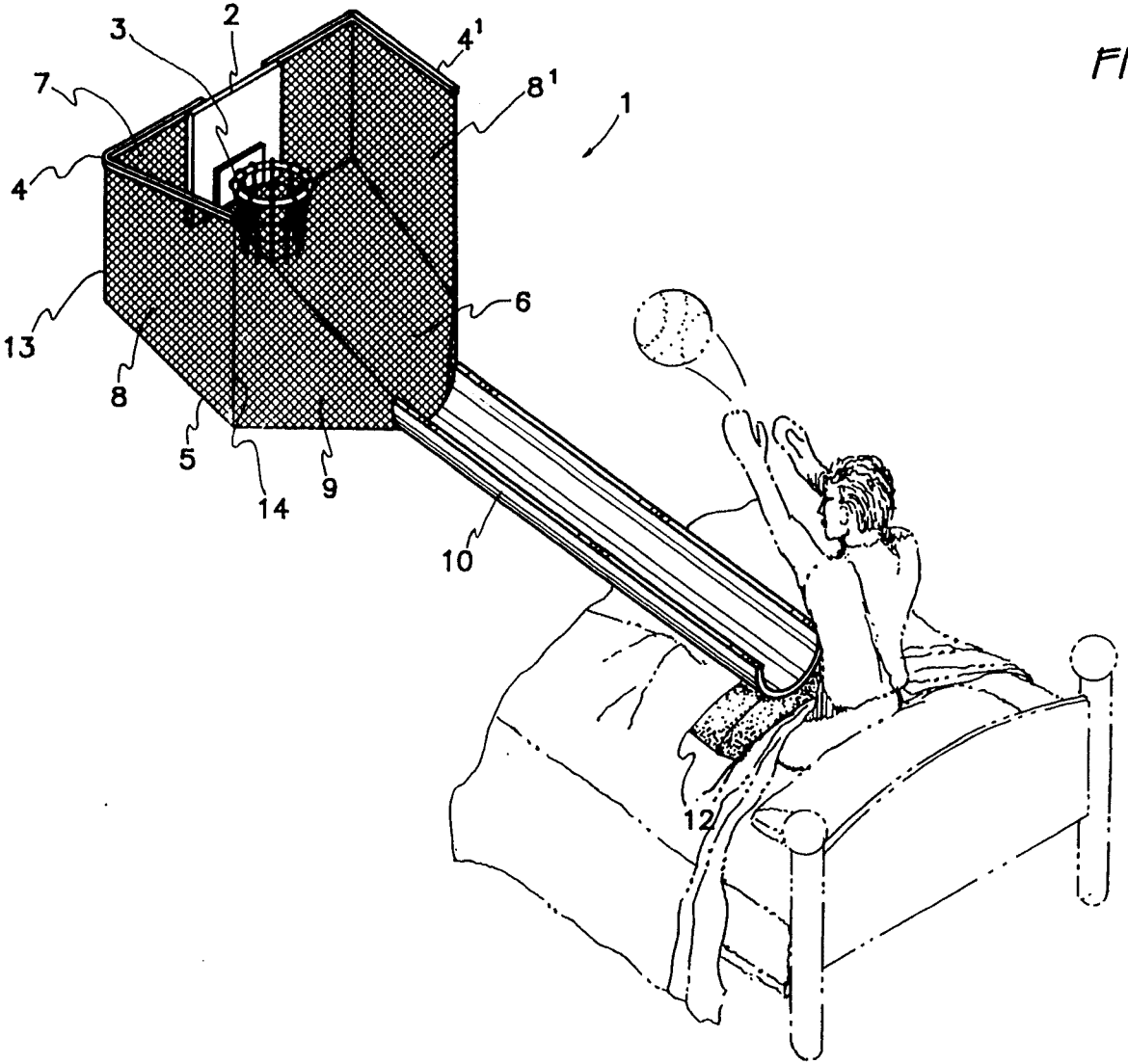
FIG. 1 is a perspective environmental view of an apparatus according to the present invention.

Referring to FIG. 1 of the drawings, the present invention defines an apparatus 1 for playing basketball while in a reclined position which includes a backboard 2, a hoop 3 perpendicularly extending from, and rigidly attached to a front face of the backboard, a catch net 5, a return trough 10, and a cushion support 12.

Backboards of wood, fiberglass, or metal may be advantageously used in the present apparatus. A pair of horizontal, rigid L-shaped members 4 and 4' are fixedly attached to a back face of backboard 2 along the top edge of the back face. These horizontal members are preferably made of a strong rigid material, such as steel, aluminum, or high tensile strength polymeric materials. They may be attached to the backboard through any appropriate fasteners, such as with screws, bolts, or the like.

Figure 3:
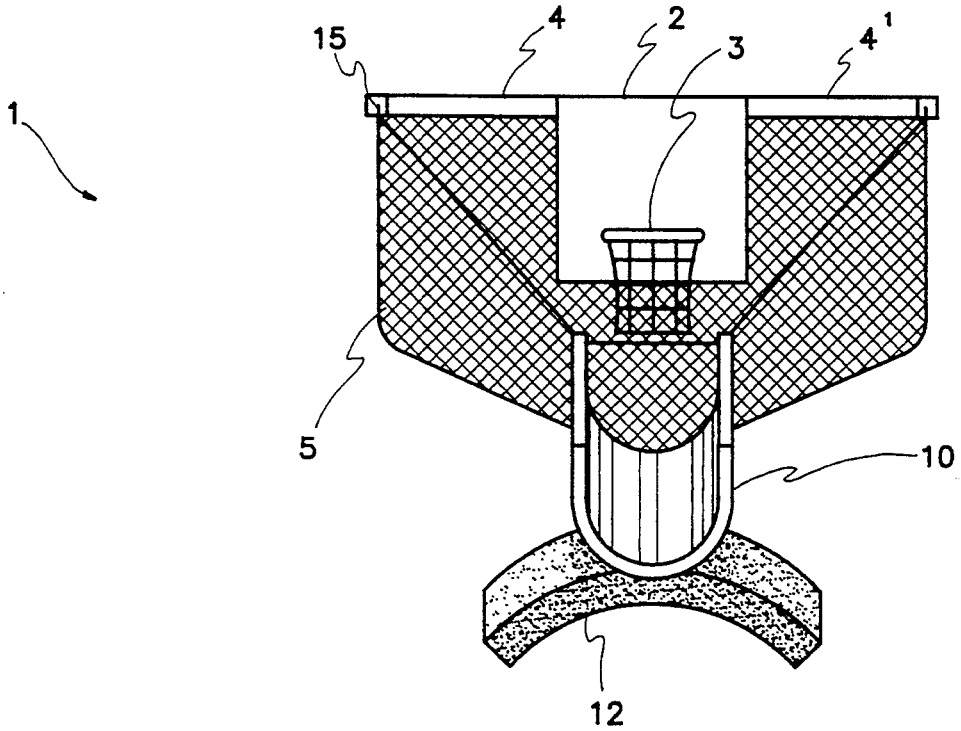
FIG. 3 is a front view of a preferred embodiment of the present invention.

The horizontal members provide a framework from which a catch net 5 is suspended. As shown in FIG. 3, grooves 15 may be provided along the bottom of the horizontal members to receive and secure the catch net. Appropriate fasteners, such as pins, eyes and hooks, or the like may be used to attach the catch net to the horizontal members. Alternatively, the catch net may be adhesively attached thereto. To provide additional framework for the catch net, vertical members 13, attached one each to the crooks of 4 and 4', and longer vertical members 14, attached to the ends of 4 and 4', may be provided. Vertical members 13 and 14 may either: serve as interior posts for the catch net, or be slotted through optionally provided vertical sleeves of the catch net.

The catch net defines substantially planar borders of an open volume around the hoop and backboard such that substantially all balls aimed at the hoop will enter this volume. Preferably, the net has a downward sloping bottom surface 6, a rectangular back surface 7, two substantially parallel trapezoidal side surfaces 8 and 8', and two converging surfaces 9 and 9'. Preferably, these surfaces form a unitary catch net. Alternatively, the catch net may be made of attached panels defining one or more of the surfaces 6, 7, 8, 8', 9, and 9'. When made of separate panels, a preferred embodiment of the catch net 5 includes vertical sleeve members between surfaces 7 and 8 (8'), and/or between 8 (8') and 9 (9'). These sleeves would be used in conjunction with, and are sized to receive, the vertical members 13 and 14.

The net may be advantageously constructed as an openwork fabric of threads, cords, or ropes which are woven or knotted together at regular intervals to form a mesh barrier. The net may be made from any suitable material such as nylon, rayon, polyester, cotton, or hemp. Preferably, catch net 5 is constructed in a manner and with materials conventionally employed for tennis or volleyball nets.

Attached to the catch net is a trough 10. The trough is of substantially rigid unitary construction, preferably of a constant U-shaped or semicircular cross-section. The trough must necessarily be of sufficient size to allow the ball to roll along its length. Though preferably of solid construction, as shown in the Figures, perforations, slots, or the like, may be provided along its length to reduce material costs.

The net is attached to the trough along the perimeter defined by one open end of the trough. Further, the net may be attached to the trough with overlap to define a smoother transition, as shown in FIG. 1. Optionally, a support line 11, is provided along the upper edge of the catch net, running through supports 4 and 4', along the top edge of surfaces 7, 8, 8', 9, and 9', as well as along the perimeter of the trough end, forming a continuous loop. This support line is preferably a cord or rope, and can be made of nylon, cotton, hemp, polyester, or the like.

Figure 2:
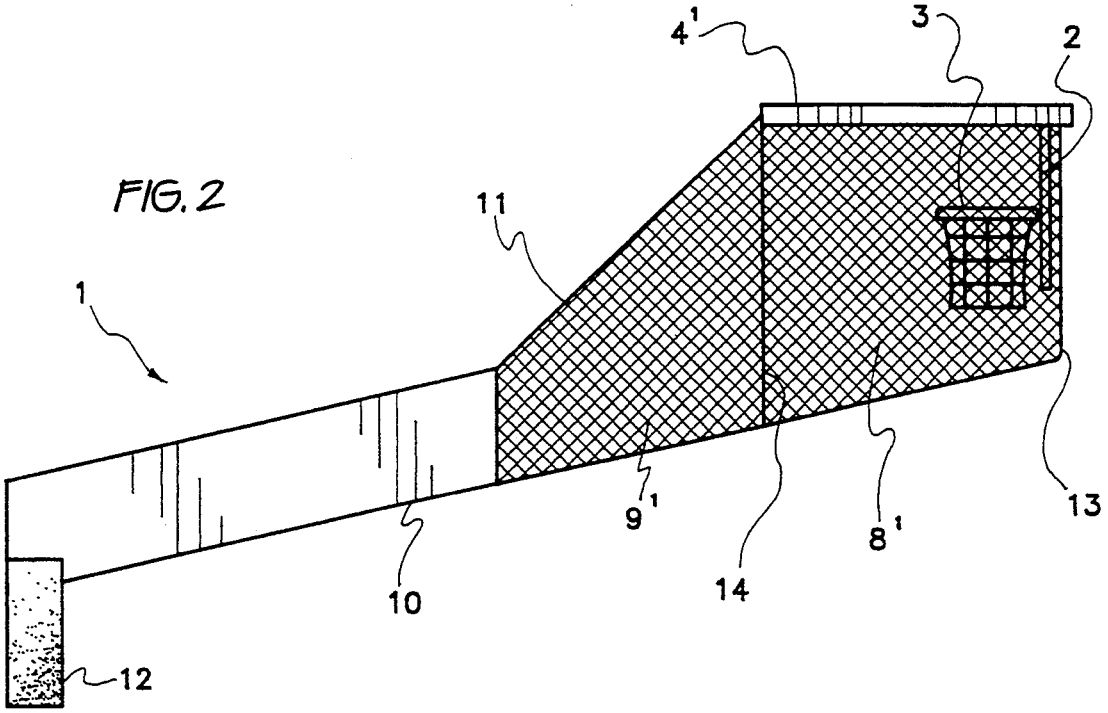
FIG. 2 is a side view of a preferred embodiment of the present invention.

A particular advantage of having a substantially rigid trough attached to the net in the present fashion is that, under gravity, the net is held tautly in shape, while providing sufficient flexibility to absorb the impact of thrown balls. As shown in FIG. 2, the trough may be attached to the catch net such that a constant angle of decent is defined for returning balls.

A support cushion 12 is attached to an underside of the return trough 10 distal from the catch net 5. As shown in FIG. 1, the support cushion may be shaped to comfortably lie on the lap of the user. Preferably, the support cushion is arched to provide added lateral stability to the trough. Though any suitable cushioning material may be used, the support cushion is most preferably made of a flexible, elastic material such as foam rubber, which may be optionally covered with a sleeve of fabric.

The present apparatus may be fastened to a post, wall, or door. This may be accomplished by any conventional manner, including permanent and/or temporary fasteners securing the post, wall, or door to the backboard 2 and/or horizontal members 4 and 4'. Alternatively, the present apparatus may itself be suspended by the transverse sections of the horizontal members, through hooks permanently or temporarily fixed to a door or wall.

Since various modification may be made to the present apparatus without departing from the spirit of the invention, it is to be understood that the present invention is not limited to the sole embodiment described above, but encompasses any and all embodiments within the scope of the following claims.

I claim:

1. An apparatus for playing basketball while in a reclined position comprising:
   a) a backboard;
   b) a hoop perpendicularly extending from, and rigidly attached to a front face of said backboard;
   c) a pair of horizontal, rigid L-shaped members fixedly attached to a back face of said backboard along a top edge of said back face;
   d) a catch net having an inclined bottom surface suspended on said L-shaped members;
   e) a substantially rigid trough attached on one end to said catch net; and
   f) a support cushion attached to an underside of an end of said return channel distal from said catch net.

2. The apparatus according to claim 1, further comprising: rigid vertical members fixedly attached to and extending downwardly from said L-shaped members.

3. The apparatus according to claim 1, wherein said catch net comprises a downward sloping bottom surface, a rectangular back surface, two substantially parallel trapezoidal side surfaces attached to said back surface and said bottom surface, and two converging surfaces attached to said side surfaces and said bottom surface.

4. The apparatus according to claim 3, wherein each of said side surfaces are attached to said back surface through a vertical sleeve member, and each of said converging surfaces is attached to one of said side surfaces through a longer vertical sleeve member.

5. The apparatus according to claim 3, wherein said bottom surface, said back surface, said side surfaces, and said converging surfaces form a unitary catch net.

6. The apparatus according to claim 1, wherein a support line is provided along the top edge of said catch net, defining a continuous loop.

7. The apparatus according to claim 1, wherein said L-shaped members comprise slots along a bottom surface to receive said catch net, and said catch net is suspended from said continuous slots through means for attaching said catch net to said slots.

* * * * *